United States Patent [19]

Erminio

[11] Patent Number: 4,784,168

[45] Date of Patent: Nov. 15, 1988

[54] OPEN WASHING CYCLE DISHWASHING MACHINE

[76] Inventor: Dall'Oglio Erminio, Quartiere Ai Serrari, 6592 S. Antonino, Switzerland

[21] Appl. No.: 29,818

[22] Filed: Mar. 25, 1987

[30] Foreign Application Priority Data

Apr. 28, 1986 [CH] Switzerland ..... 1743/86

[51] Int. Cl.[4] ..... B08B 3/02; B08B 13/00

[52] U.S. Cl. ..... 134/100; 134/177; 222/135; 222/341

[58] Field of Search ..... 134/100, 101, 107, 177, 134/179; 68/17 R; 222/135, 341

[56] References Cited

U.S. PATENT DOCUMENTS

| | | | |
|---|---|---|---|
| 1,819,381 | 8/1931 | Palmer | 222/341 X |
| 1,866,237 | 7/1932 | Thompson et al. | 222/341 |
| 2,154,566 | 4/1939 | Frantz et al. | 68/17 R X |
| 2,592,885 | 4/1952 | Fox et al. | 134/101 X |
| 2,669,999 | 2/1954 | McMillan | 134/179 X |
| 2,673,761 | 3/1954 | Karlstrom | 134/177 X |
| 2,746,465 | 5/1956 | Farison | 134/100 X |
| 3,094,247 | 6/1963 | Marchi | 68/17 R X |
| 4,218,264 | 8/1980 | Federighi et al. | 68/17 R X |

*Primary Examiner*—Philip R. Coe

*Attorney, Agent, or Firm*—Finnegan, Henderson, Farabow, Garrett & Dunner

[57] ABSTRACT

A dishwashing machine comprises a washing tank closed by a lid and containing a removable utensils basket, and also comprising rotary spray arms with nozzles, which arms are mounted rotatably within the washing tank and fed by a hydraulic circuit. The washing tank has an open discharge port on its base and the fluid circuit comprises a delivery line for water under pressure which empties into a mixing chamber connected by tubes to the spray arms. The delivery line of at least one pump aspirating from a washing additive reservoir also empties into the mixing chamber.

8 Claims, 3 Drawing Sheets

OPEN WASHING CYCLE DISHWASHING MACHINE

The present invention relates to a dishwashing machine, in particular for the rapid washing of glasses, cups, plates and other utensils of the kind used in public eating and/or drinking places, communities, etc.

In traditional dishwashing machines of the type in question there is a washing tank in which is fitted a basket for the said utensils and a plurality of spray nozzles which send jets of water onto the utensils through the action of a recirculation pump which takes off the water from the bottom of the said tank; a detergent is also introduced directly into the tank and mixes with the water during the washing cycle.

Periodically the pump sends the wash liquid to waste, in particular after the washing cycle and after one or more rinsing cycles.

In these dishwashing machines a relatively large throughput of water is sprayed at low pressure onto all the utensils arranged in the basket, and then falls into the collection tank from which the selfsame water is taken off and continuously recycled by the aforesaid recirculation pump.

This means that the dirt and disease-causing bacteria on any utensil mix with the recycled washing water and thus soil and contaminate all the other utensils, with obviously undesirable results. this drawback exists even if the water is changed very frequently during the complete operating cycle of the dishwashing machine.

Additionally, dishwashing machines of the type described above are from the mechanical standpoint relatively complicated and also suffer from the disadvantage of an elevated consumption of detergent and electrical energy.

The principal object of the present invention is to overcome the disadvantages of the known art by embodying a dishwashing machine that will wash with water which is always clean and thus in a bacteriologically hygienic manner.

Another object of the invention is to embody a dishwashing machine that is highly efficient, constructionally very straightforward and small in bulk and which performs washing cycles rapidly, with minimal consumption of detergent and electrical energy.

The present invention attains the said objects by providing a dishwashing machine comprising a washing tank closed by a lid and containing a removable basket for holding utensils, and also comprising rotary spray arms supported rotatably on the interior walls of the tank and fed by a fluid circuit, wherein the tank has an open discharge port on its base and wherein the fluid circuit comprises an inlet for water under pressure which debouches into a mixing chamber connected by tubes to the spray arms, the delivery side of at least one pump aspirating from a washing additive reservoir.

With a pump interposed, the inlet for the water under presure can be connected to a washing water storage tank housed within the dishwashing machine itself.

The objects and advantages of the present invention, and the essential characteristics of the dishwashing machine which it embodies, will become more apparent from an examination of the following description of one form of embodiment thereof as shown in the appended drawings, in which.

Figure 1:
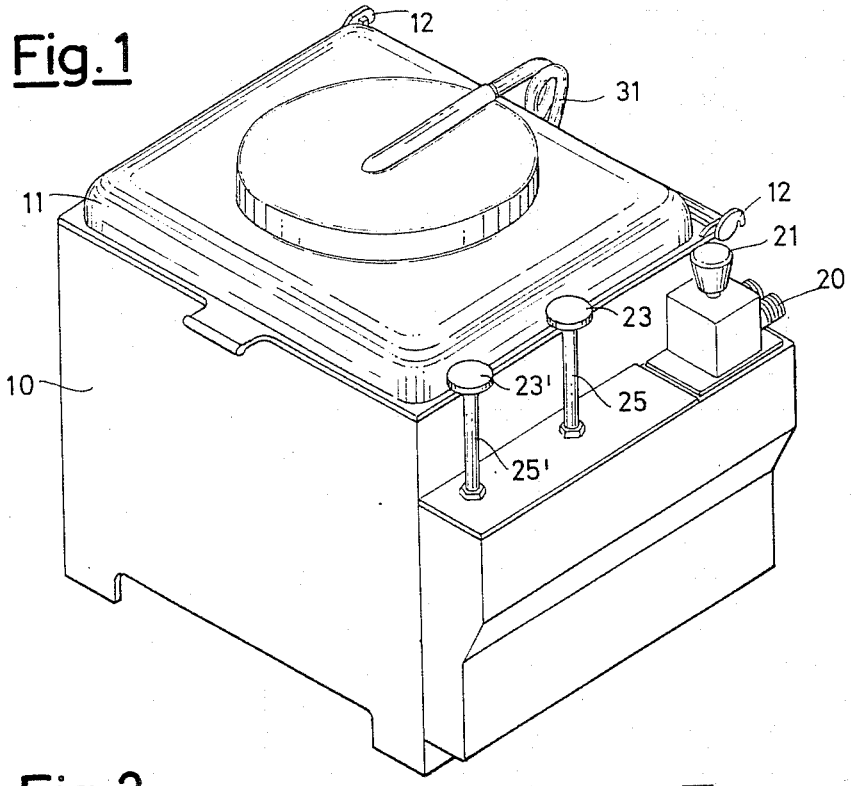
FIG. 1 is a diagrammatic perspective view of the dishwashing machine.
Figure 2:
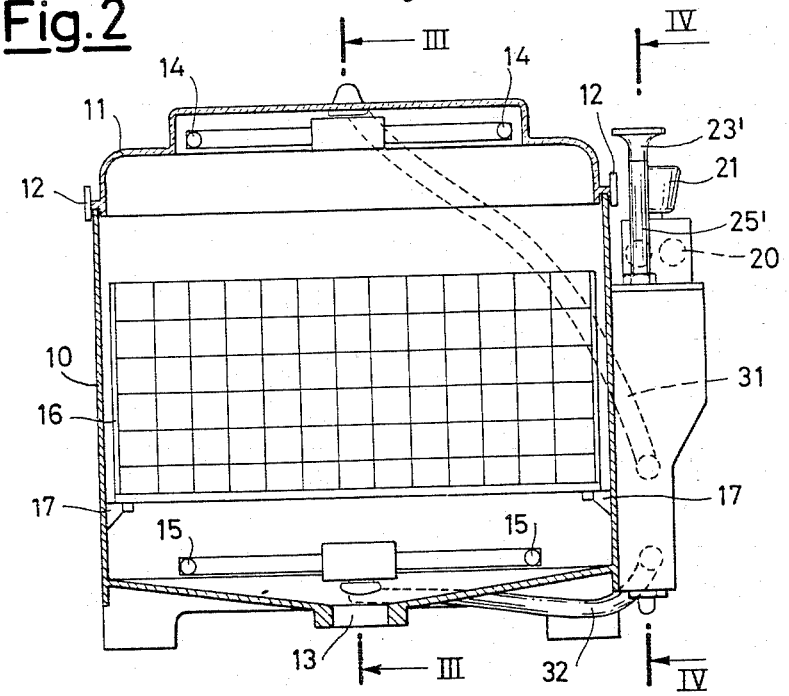
FIG. 2 is a sectional view taken along line II—II in FIG. 3.
Figure 3:
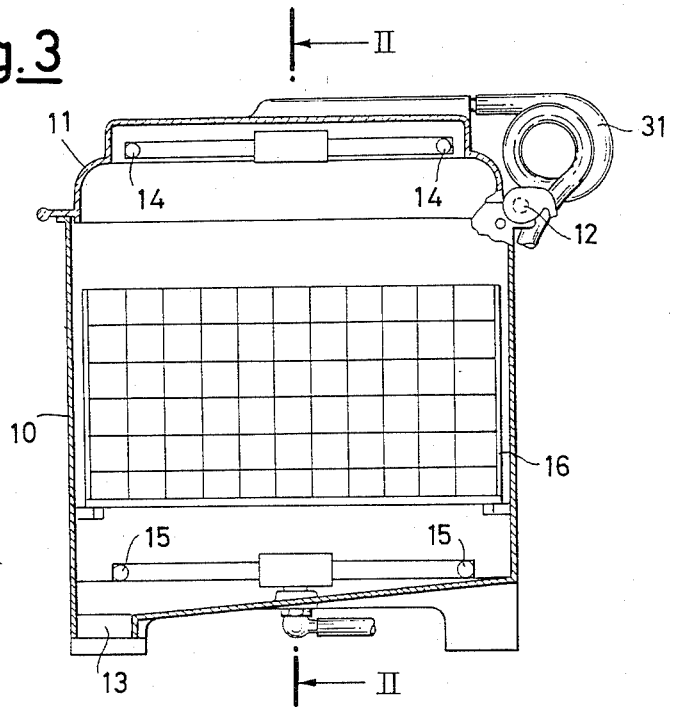
FIG. 3 is a sectional view taken along the line III—III in FIG. 2
Figure 4:
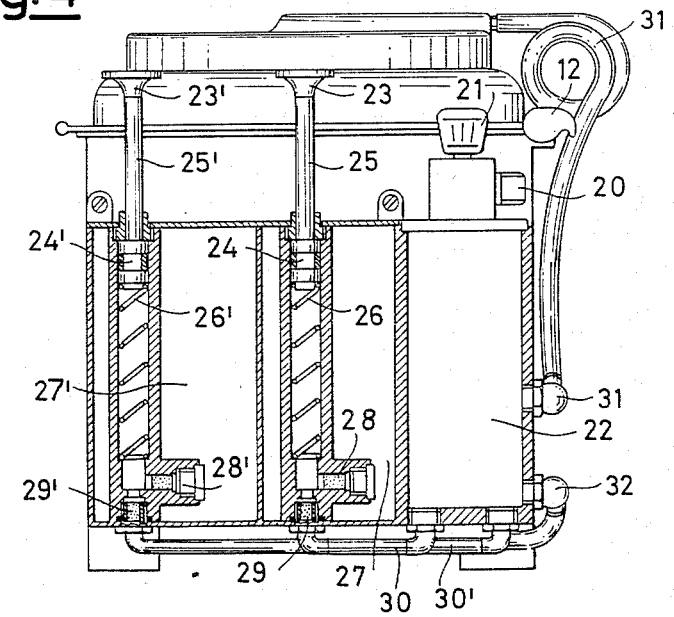
FIG. 4 is a sectional view through the line IV—IV in FIG. 2.

As can be seen from the drawings, the dishwashing machine comprises a washing tank 10, closed by a lid 11 which is hinged at 12. The base of the tank has a gravity discharge port 13.

Rotary spray arms 14,15 are mounted on the lid 11 and on the base of the machine respectively; these arms feature the spray nozzles which, as in the known art, are so oriented as to cause the arms to rotate by reaction, the pin of the arms forming a rotary fitting for the conduction of the washing water. Being per se know, these particulars are not here described in detail.

The tank 10 houses a utensils basket 16 which rests on relative supports 17 in a removable manner.

The fluid circuit of the dishwashing machine illustrated in FIGS. 1–4 has an inlet 20 controlled by a valve 21 which empties into a mixing chamber 22; the delivery side of a manual positive-displacement pump 23 with piston 24 is controlled by a shaft 25 to move against the pressure of a spring 26.

The pump 23 aspirates from a reservoir 27 detergent or in general a product intended to be dissolved in the washing water to clean or disinfect the utensils.

As will be clear to a person with ordinary skill in the art, the pump has check valves on the aspiration and delivery sides, these being shown in the drawing diagrammatically at 28 and 29.

A pump 23' entirely similar to the pump 23 is provided flanking this latter, and its component parts are therefore indicated by the same reference numerals followed by an apostrophe.

As the drawings show, the chamber 22 and the pumps 23 and 23' with respective chambers 27 and 27' can be advantageously mounted on a side of the tank, thus with minimum bulk.

Lastly, the chamber 22 is provided with two outlets 31 and 32 that are connected by relative tubes to the supports of the rotary arms 14 and 15 to feed the nozzles.

As called for by the objects of the present invention, the dishwashing machine has a very simple manner of operating.

The inlet 20 is directly connected to the water mains where the pressure is usually appreciable, for examples in the region of 2–3 atmospheres.

When the valve 21 is turned on, the water fills the chamber 22 passes through tubes 31,32 and is expelled unimpeded from the nozzles of the spray arms 14 and 15. The nozzles are so sized that they expel relatively narrow jets, the operation of the dishwashing machine according to the invention being principally based on the energetic dynamic action of water, even when its flow rate is relatively low.

The water delivered is removed in a countinous manner through the discharge port 13, which means that the washing is always done with a flow of clean and not recycled water; as a result, the jets prove very efficient in removing residues from the utensils, without any re-depositing of dirt as occur in the closed cycle of the traditional washing machines in common use.

During the flow of the washing water the operator depresses the shaft 25 so as to introduce a metered amount of additives(e.g. detergent) into the mixing chamber 22; for a brief period, therefore, the water delivered by the nozzles of the spray arms contains additives for the express purpose of bringing to bear on the utensils a specific action, for example a chemico-physical action of emulsification and detachment of greases on the utensils.

With a minute or a fraction of a minute, the water has removed the additive from the chamber 22, which also acts as an additive pre-dissolution chamber.

If wished, the operator can in like manner depress the shaft 25' to inject a second additive into the flow.

It should here be stressed that the number of pumps 23 will be governed by the specific performances required of the machines and the number of additives it is wished to add to the washing water. Two pumps can be provided for the introduction of acid and basic detergent separately, with pH neutralization at discharge and on the utensils, or else for the introduction of disinfectant or any other substance useful for cleaning and sterilizing the utensils.

There can therefore be provided one pump 23 or any desired number of pumps 23.

After the final introduction of additives, water flow is continued for a short period of time, again a minute or a fraction of a minute, with the result that the utensils prove thoroughly rinsed because clean water—which is thereafter at once sent to waste—is directed onto them.

Within a very short space of time, for example 2–5 minutes, the utensils are cleaned in a wholly satisfactory manner and this also as regards disinfection.

It should be noted that the continous nature of the water flow in the dishwashing machine according to the invention also has the advantageous effect of preventing the dirt on each utensil from depositing on and spreading over the others, which is what occurs in re-cycling machines, inasmuch as the present machine washes each utensil individually.

This makes the dishwashing machine according to the invention particularly useful for use in public eating and/or drinking places, communities, etc.

The high speed of operation of the machine, and the moderate flow rate required for it, place a limit on the volume of water needed for each cycle, despite the fact that it operates with open cycle and continuous discharge. The greater efficiency and sterility of the washing is therefore not to any appreciable extent penalized by water consumption.

Particularly worthy of note is the fact that in the dishwashing machine according to the invention the additive arrives, dissolved in the water, directly onto the utensil to be washed, and thus exerts its full detergent and disinfectant power in that it does not first come into contact with any polluting agent as is the case with dishwashing machines operating with closed washing cycle and re-circulation.

Figure 5:
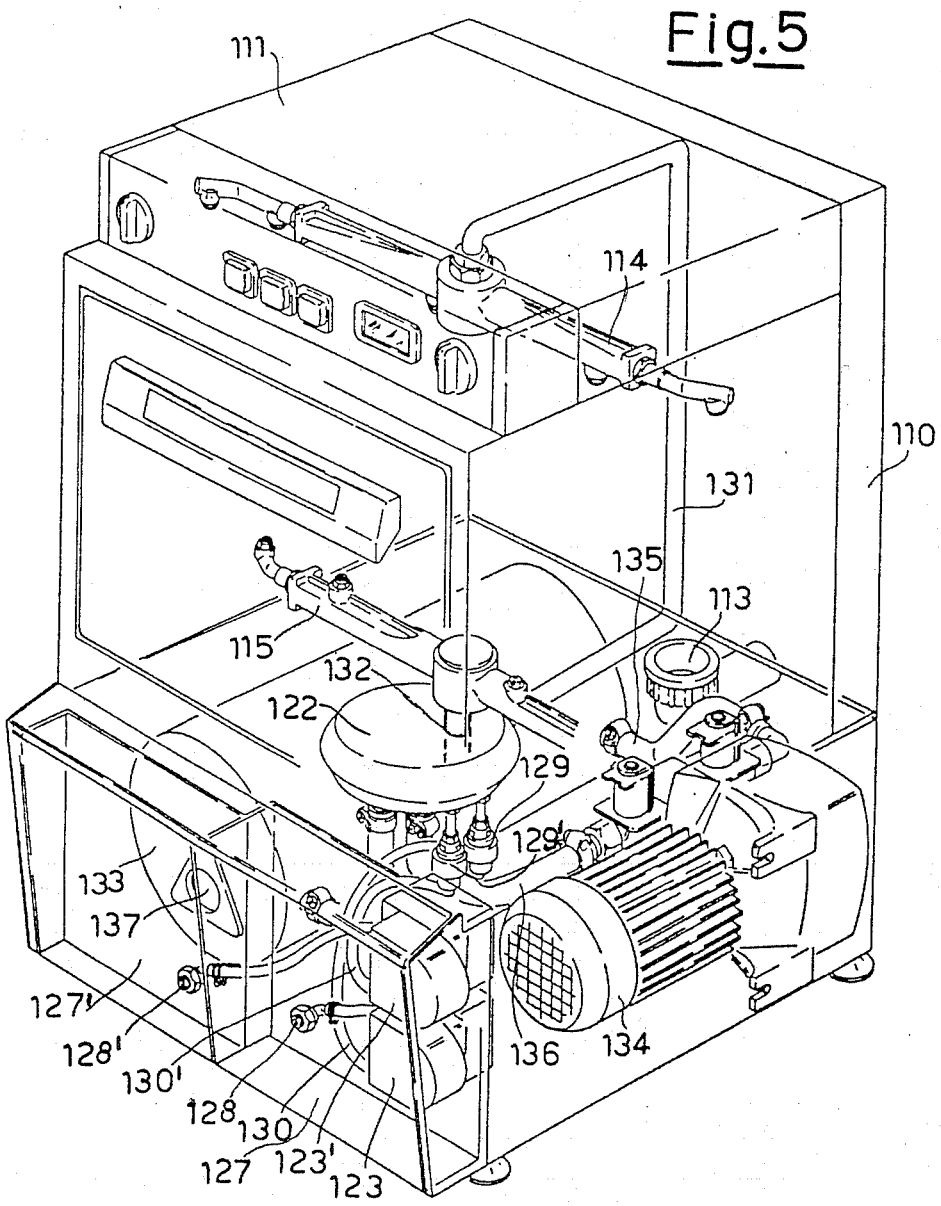
FIG. 5 is a perspective view illustrating a further possible embodiment of a dishwashing machine incorporating the principles of the invention.

FIG. 5 of the drawings illustrates a further possible form of embodiment of the dishwashing machine of the invention, in which the components that are identical with, or substantially equivalent to those of the machine shown in FIGS. 1–4, are indicated by the same reference numbers increased by 100.

Instead of operating with a direct connection to the water mains, with an interposed control valve, the machine of FIG. 5 incorporates a washing water storage tank 133 associated with an electrical resistor for heating the said water, of a type per se known and therefore not illustrated. The washing water is taken off from the storage tank 133 by means of a pump unit 134 which sends it at high pressure—typically more than 2 atmospheres—to the interior of the circular mixing chamber 122 where it becomes intimately mixed with the detergent and disinfectant substances pumped from the chambers 127 and 127'. The pump unit 134 is connected to the storage tank 133 and to the chamber 122 by an aspiration duct 135 and a delivery duct 136 respectively.

The numeral 137 indicates a connection through which the storage tank 133 can be filled; as will be clear, the outlet 113 can be provided with a discharge pump.

The objects mentioned in the introductory part of the present specification are therefore attained, that is to say the embodiment of a dishwashing machine that will carry out a washing cycle in a short space of time, using a minimum volume of always clean water at high pressure with which the detergent and disinfecting substances are pre-mixed before the water is introduced into the washing tank. The results obtained are surprising as regards the quality of washing, energy saving and economy in the use of detergent and disinfecting products, very short cycles being achieved whether use is made of hot or cold water.

I claim:

1. In a dishwashing machine having a washing tank for holding a removable basket for receiving articles to be washed, a lid for the tank, at least one rotary spray arm rotatably mounted on an interior wall of the tank and having nozzles for spraying wash or rinse water onto the articles, and an outlet in the base of the tank for continuously discharging spent water to waste, the improvement comprising a mixing chamber having an outlet communicating with said spray arm nozzles and an inlet for connection to a supply of water under pressure, a valve for controlling the flow of water to the mixing chamber, a plurality of reservoirs for holding additives to be mixed with said water, a separate manually-operated, spring biased positive displacement pump for each reservoir, each pump having an inlet communicating with a reservoir and an outlet communicating with said mixing chamber, whereby the additives can be selectively introduced into the mixing chamber upon actuation of a pump to mix them with the water prior to being fed to the spray arm.

2. The dishwashing machine of claim 1, including a pump for increasing the pressure of the water fed to the mixing chamber.

3. The dishwashing machine of claim 1, wherein the lid is the top cover of the washing tank and the spray arm is rotatably mounted in its center.

4. The dishwashing machine of claim 3 including a rotating spray arm with nozzles rotatably mounted in the center of the base of the tank.

5. The dishwashing machine of claim 3, including shelf elements that project from the inside of the sidewalls of the washing tank to support the basket.

6. The dishwashing machine of claim 3, wherein the mixing chamber and the reservoirs are mounted on the outside of one of the sidewalls of the tank.

7. The dishwashing machine of claim 3, wherein the chamber is connected to the arm mounted on the lid by a flexible hose.

8. The dishwashing machine of claim 7, wherein the mixing chamber is circular in shape.

* * * * *